United States Patent [19]

Doerner

[11] 4,412,667

[45] Nov. 1, 1983

[54] LEG FOR CHAIR BASE AND CAP THEREFORE

[76] Inventor: Frank Doerner, 138 Aberdeen Rd., Kitchener, Ontario, Canada, N2M 2Y7

[21] Appl. No.: 286,890

[22] Filed: Jul. 27, 1981

[30] Foreign Application Priority Data

Feb. 12, 1981 [CA] Canada ..... 370735

[51] Int. Cl.[3] ..... A47B 91/00

[52] U.S. Cl. ..... 248/188.7; 248/188.8; 248/188.9

[58] Field of Search ..... 248/188.7, 188.1, 188.8, 248/188.9

[56] References Cited

U.S. PATENT DOCUMENTS

| | | | |
|---|---|---|---|
| 2,217,754 | 10/1940 | Johnson | 248/188.7 |
| 2,732,157 | 1/1956 | Hamilton | 248/188.7 |
| 3,148,855 | 9/1964 | Hamilton | 248/188.7 |
| 3,390,421 | 7/1968 | Sullivan | 248/188.7 |

FOREIGN PATENT DOCUMENTS

| | | | |
|---|---|---|---|
| 1433057 | 4/1976 | United Kingdom | 248/188.7 |

*Primary Examiner*—J. Franklin Foss
*Assistant Examiner*—Sarah A. Lechok
*Attorney, Agent, or Firm*—Riches, McKenzie & Herbert

[57] ABSTRACT

A chair leg and a protective cap therefor. The cap is adapted to fit over and be secured to the end portion of the chair leg. The cap has a small protrusion on the inside top surface which fits into and is secured by an aperture in the upper surface of the chair leg. The cap has also an aperture in the bottom surface which fits over and is secured by a portion of the socket which extends below the plane of the lower surface of the end portion of the chair leg. This new structure reduces significantly the cost of production by eliminating the need to grind and buff the end portion of the chair leg yet produces a smooth, safe and acceptable end for the chair leg.

6 Claims, 5 Drawing Figures

LEG FOR CHAIR BASE AND CAP THEREFORE

BACKGROUND OF THE INVENTION

1. Field of the Invention

This invention relates generally to legs for chairs and more particularly, to a novel leg and cap combination, which is to be used in conjunction with a caster.

2. Description of the Prior Art

Chairs, particularly those chairs used in offices, generally comprise a seat and back portion, and a base portion which consists of a chair control mounted on a cylindrical post with a plurality of legs which extend radially outwardly from the base of the post. A caster is usually affixed to the undersurface of each leg at the end thereof, which allows the chair to move about freely.

In order to secure the caster to each leg, a hole is cut in the undersurface of the leg and a caster socket is inserted therein. The stem of the caster is inserted into the socket and secured therein by a conventional means.

The chair leg may be made of any suitable material such as steel, plastic, wood and the like and in order to make an aesthetically pleasing product, the end of the leg must be smooth and continuous. This presents a problem with legs made of a metal or an alloy thereof, or similar material, in that considerable grinding and buffing is necessary after the material is welded to form the leg. With such legs, the terminal portion of the leg must be ground smooth and all weld lines and rough or sharp edges must be removed. This requires a considerable amount of precision work and increases the cost of production substantially. Depending upon the exact shape of the leg, a considerable number of welding and buffing steps are required to produce a smooth and commercially acceptable product, and each such step increases the cost, materials and time required for production.

It is essential in the finished product, that the end of the leg be perfectly smooth. In addition to the problem of aesthetics, the end of the leg must be smooth to prevent any damage which might arise should the user of the chair strike his shoe, stocking or the like on the end or if the end strikes any other piece of furniture. Any sharp edges may cause damage or leave undesired marks on other furniture, even under normal use conditions.

SUMMARY OF THE INVENTION

Accordingly, it is an object of the present invention to at least partially overcome these disadvantages by providing a new structure for the end of the leg together with a protective cap therefor, which reduces significantly the cost of production and yet produces a smooth and safe end for the chair leg.

It is a further object of this invention to provide an improved chair leg with a protective cap therefor, which eliminates the need for grinding and buffing of the end portion thereof and yet produces a clean and acceptable product.

To this end, in one of its aspects, the invention provides a chair leg and a protective cap therefore, said chair leg consisting of a leg portion and an end portion, said end portion having a caster socket inserted therein, said cap adapted to fit over and be secured to said end portion of said leg.

In another of its aspects, the invention provides a steel chair leg and a resilient, plastic cap for use therewith, said chair leg consisting of a leg portion which is rectangular in cross-section with a rounded end portion, said end portion having a flat upper and a flat lower surface, and a first aperture in the upper surface and a second aperture in the lower surface, said end portion having a caster socket welded therein and extending marginally outwardly beyond the plane of the lower surface, said cap having a small protrusion on the inside top surface which is adapted to fit into and be secured by said first aperture, and an aperture in the bottom surface of said cap which is adapted to fit over and be secured by the portion of the socket extending beyond the plane of the lower surface of said end portion.

In yet another of its aspects, the invention provides a chair which consists of a back and a seat portion, a chair control affixed to the undersurface of said seat and mounted on a vertically-aligned part, and a plurality of radially extended legs, each leg consisting of a leg portion which is rectangular in cross-section with a rounded end portion, said end portion having a flat upper and a flat lower surface and a first aperture in the upper surface and a second aperture in the lower surface, said end portion having a caster socket welded therein, and extending marginally outwardly beyond the plane of the lower surface, and a resilient, plastic cap adapted to fit over and be retained on said end portion, said cap having a small protrusion on the inside top surface which is adapted to fit into and be secured by said first aperture, and an aperture in the bottom surface of said cap which is adapted to fit over and be secured by the portion of the socket extending beyond the plane of the lower portion of said end portion.

DESCRIPTION OF THE PREFERRED EMBODIMENT

Figure 1:
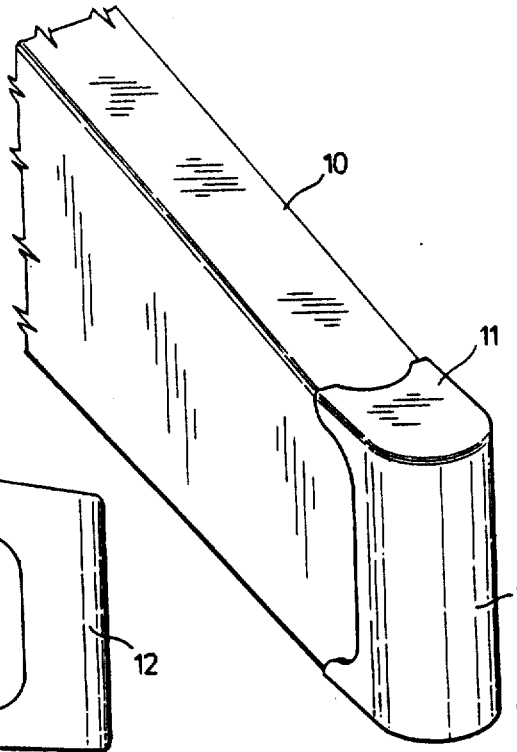
FIG. 1 is a front prospective view of an end of a chair leg and protective cap therefore, in the assembled condition.
Figure 2:
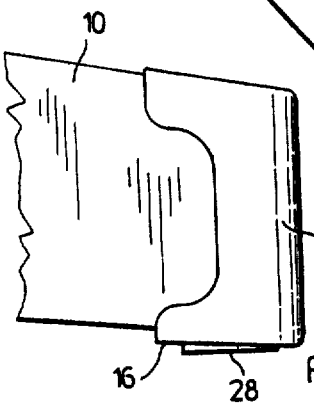
FIG. 2 is a side elevational view of FIG. 1.
Figure 3:
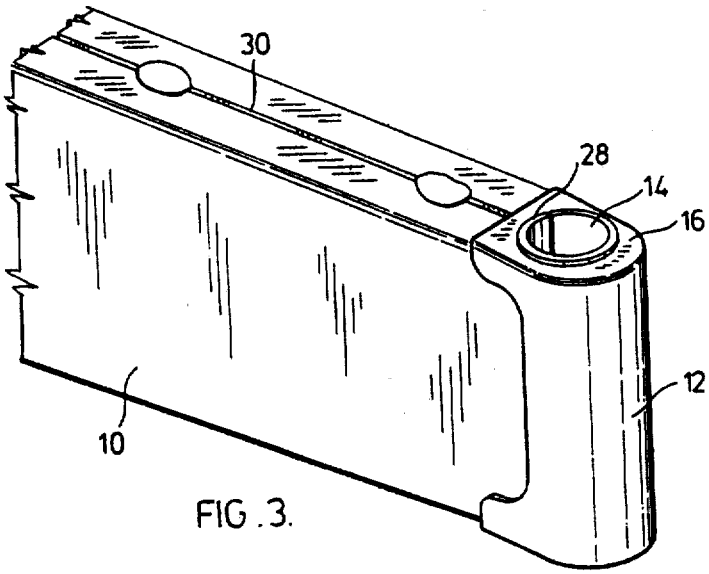
FIG. 3 is a bottom perspective view of an end of a chair leg and protective cap therefor, in the assembled condition.

Reference is first made to FIG. 1 which shows a front perspective view of the assembled chair leg and protective cap. Chair leg 10 is shown throughout the drawings as a tubular, rectangular body but it is understood that this shape may be varied with the scope of the present invention. A protective cap 12 is fitted over one end of the leg 10 and the other end (not shown) is secured to a central part of the chair. The cap 12 is of a shape to correspond to the end of the leg 10 and as shown in FIGS. 1 and 3 extends marginally inwardly along the sides of the leg 10.

As stated before, the shape of leg 10 may vary and accordingly, the shape of the cap 12 will vary. In a preferred embodiment, the leg 10 is rectangular in section and this particular embodiment will now be described.

Cap 12 is generally C-shaped with a flat top surface 11 and a flat bottom surface 16. The inside of cap 12 is concave in shape to fit the end of the leg 10 as will be explained hereinafter. A hole 14 is cut in the bottom surface 16 of cap 12 and a small protrusion 18 is on the interior of top surface 11 of cap 12.

Figure 4:
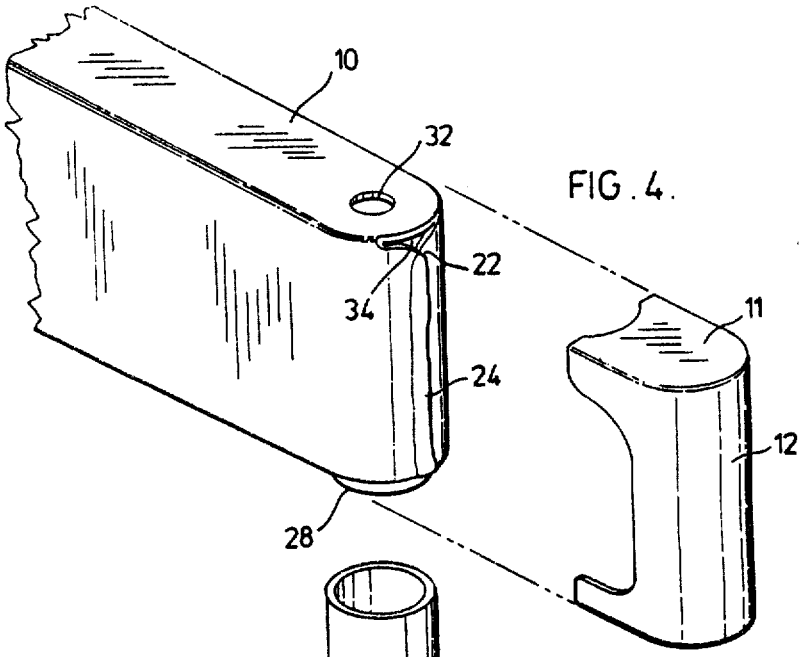
FIG. 4 is an exploded view of FIG. 1.
Figure 5:
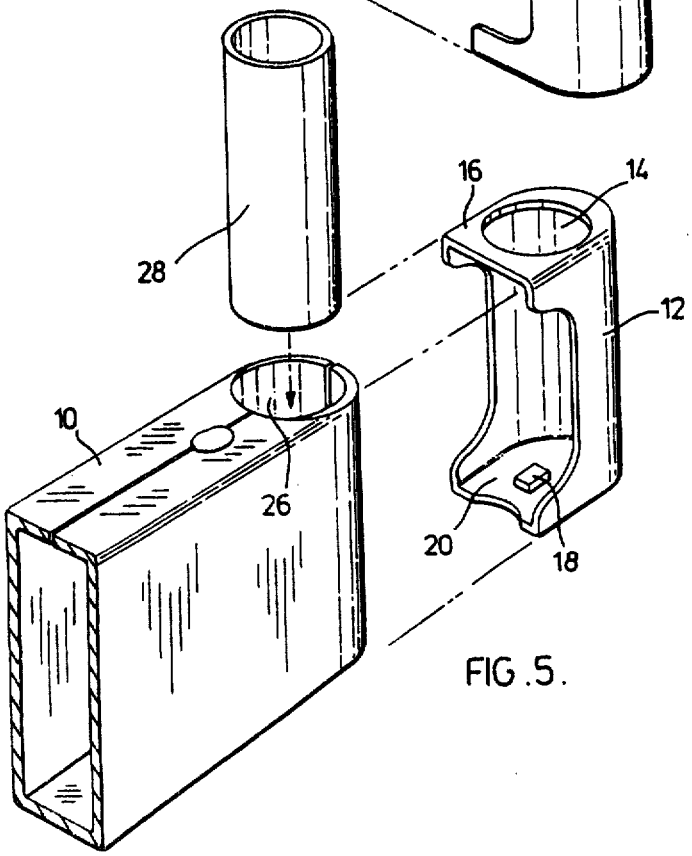
FIG. 5 is an exploded view of FIG. 3.

The leg 10 may be made of any suitable material and preferably of steel or an alloy thereof. The leg 10 is first bent and formed in the desired shape, preferably to a tubular, rectangular shape and the free ends of the leg 10 are bent simultaneously to close off the end portion 22 of leg 10, as shown in FIG. 4. A hole 26 is then punched through the bottom surface of the leg 10 and a caster socket 28 is dropped into hole 26. The length of the socket 28 is such that a small part thereof extends outwardly beyond the plane of the bottom surface of the leg 10, as shown in FIG. 3.

The ends of the leg 10 are then bent closed as shown in FIG. 4 and the leg is now ready for welding. The bottom seam 30 is first welded, preferably by spot welding and then a vertical seam 24 is welded on the terminal end of the leg which secures the socket 28 in place. A small hole 32 is punched through the top surface of the leg 10 as shown in FIG. 4 at any suitable time. The leg 10 is now ready for chrome plating, if desired.

The cap 12 may be made of any suitable resilient material and is preferably, made of plastic material. Of the plastics, it has been found that polyethylene is most suitable. Its method of manufacture will of course depend upon the material from which it is made, and it may be coloured or otherwise treated if desired.

After leg 10 has been constructed, the protective cap 12 is press-fitted over the end of the leg 10 as shown in FIG. 4. It is held in place by the protrusion 18 which sits in hole 32 and by forcing the bottom surface 16 of cap 12 over the marginally protruding portion of socket 28 which snaps or fits into hole 14. Thus, both the top and bottom surfaces of the cap 12 are held in place on leg 10. The cap 12 may also be removed by forcing a tool between the cap 12 and the leg 10 and sliding the cap 12 off the leg 10. Since the cap is resilient, it can be easily removed and replaced if desired.

If the protective cap 12 were not present as with the prior art devices, it is necessary to introduce two additional welding steps as well as additional grinding and buffing steps. First, the vertical weld seam 24 must be welded to both the top and bottom surfaces of the leg 10. As shown in FIG. 24, gap 34 on the top surface and or corresponding gap on the bottom surface (not shown) must be closed by welding. After these additional welding steps have been completed, it would be necessary to grind all these weld seams smooth and to buff the product. Conventionally, the leg is placed into contact with a grinding belt and after the grinding has been completed, the leg is buffed with a buffing wheel. The grinding steps require the use of at least three different belts of differing textures which wear out very quickly.

The present invention has successfully eliminated these steps. By using this invention, two additional welding procedures and all the grinding and buffing steps have been eliminated as the protective cap 12 will hide the weld seam 24. Thus, the present invention reduces significantly the costs involved both in materials used and also more importantly, the manpower and the time required to produce a finished product.

Once in place, cap 12 is held securely thereby giving the chair leg a finished look while substantially reducing its costs of production. It provides the necessary protection should the user of the chair inadvertently strike the leg and also, will not mar other furniture if the chair leg strikes a desk or similar structure. The resiliency allows the cap to be removed, if desired, and results in an aesthetically pleasing product.

Although the disclosure describes and illustrates a preferred embodiment of the invention, it is to be understood the invention is not restricted to this particular embodiment.

What I claim is:

1. A chair leg and a protective cap therefore, said chair leg consisting of a leg portion and an end portion, said chair leg being rectangular in cross-section with a rounded end portion, with a first aperture in the top surface thereof, and a second aperture in the bottom surface thereof, a caster socket being inserted through said second aperture, the length of said caster socket being greater than the length of said end portion, said socket being welded inside of said end portion of said chair leg, said cap being adapted to fit over and be secured to said end portion of said leg and having a small protrusion on the inside top surface which is adapted to fit into and be secured by said first aperture.

2. A chair leg and a protective cap therefore, as claimed in claim 1 wherein said cap has an aperture in the bottom surface thereof through which said caster socket extends when said cap is press fitted onto said end portion.

3. A chair leg and a protective cap therefore as claimed in claim 2 wherein said cap is made of a resilient, plastic material.

4. A chair leg and a protective cap therefore as claimed in claim 3 wherein said cap is made of polyethylene.

5. A steel chair leg and a resilient, plastic cap for use therewith, said chair leg consisting of a leg portion which is rectangular in cross-section with a rounded end portion, said end portion having a flat upper and a flat lower surface, and a first aperture in the upper surface and a second aperture in the lower surface, said end portion having a caster socket welded therein and extending marginally outwardly beyond the plane of the lower surface, said cap having a small protrusion on the inside top surface which is adapted to fit into and be secured by said first aperture, and an aperture in the bottom surface of said cap which is adapted to fit over and be secured by the portion of the socket extending beyond the plane of the lower surface of said end portion.

6. A chair which consists of a back and a seat portion, a chair control affixed to the undersurface of said seat and mounted on a vertically-aligned part, and a plurality of radially extended legs, each leg consisting of a leg portion which is rectangular in cross-section with a rounded end portion, said end portion having a flat upper and a flat lower surface and a first aperture in the upper surface and a second aperture in the lower surface, said end portion having a caster socket welded therein, and extending marginally outwardly beyond the place of the lower surface, and a resilient, plastic cap adapted to fit over and be retained on said end portion, said cap having a small protrusion on the inside top surface which is adapted to fit into and be secured by said first aperture, and an aperture in the bottom surface of said cap which is adapted to fit over and be secured by the portion of the socket extending beyond the plane of the lower portion of said end portion.

* * * * *